US010047731B2

(12) United States Patent
Deshpande et al.

(10) Patent No.: US 10,047,731 B2
(45) Date of Patent: Aug. 14, 2018

(54) PLASMA PROPELLANT ABLATION/SUBLIMATION BASED SYSTEMS

(71) Applicant: The United States of America as represented by the Secretary of the Navy, Washington, DC (US)

(72) Inventors: Nishkamraj U. Deshpande, Novi, MI (US); H. Fred Barsun, Bloomington, IN (US); Steven D. Clark, Bloomfield, IN (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 373 days.

(21) Appl. No.: 14/735,774

(22) Filed: Jun. 10, 2015

(65) Prior Publication Data

US 2016/0290324 A1 Oct. 6, 2016

Related U.S. Application Data

(60) Provisional application No. 62/143,319, filed on Apr. 6, 2015.

(51) Int. Cl.
*F03H 1/00* (2006.01)

(52) U.S. Cl.
CPC ..... *F03H 1/0087* (2013.01); *F03H 1/0012* (2013.01)

(58) Field of Classification Search
CPC .... F03H 1/0081; F03H 1/0087; F03H 1/0093; F03H 1/0012; H05H 1/32; H05H 1/48; H05H 1/26; H05H 1/42
See application file for complete search history.

(56) References Cited

U.S. PATENT DOCUMENTS 5,538,765 A * 7/1996 Kurihara ..... C23C 16/276 423/446
7,516,610 B2 4/2009 Gilchrist et al.
(Continued)

FOREIGN PATENT DOCUMENTS

CN 2808400 * 8/2006 ..... B23K 10/00

OTHER PUBLICATIONS

Nanoparticle Electric Propulsion: Experimental Results; AIAA-2006-4803; Louis Musinski, Thomas Liu, Brian Gilchrist, Alec Gallimore, and Michael Keidar; 12 pages.
(Continued)

*Primary Examiner* — William H Rodriguez
*Assistant Examiner* — William Breazeal
(74) *Attorney, Agent, or Firm* — Christopher A. Monsey

(57) ABSTRACT

Systems and methods for improving plasma propellant ablation/sublimation based systems are provided. One set of embodiments provides systems and methods for reducing carbon charring during plasma system (e.g., a plasma coating application system) propellant (e.g., a carbon-fluorine polymer) ablation and increasing heat transfer, ablation, and plasma thrust from plasma systems. In particular, one embodiment can include using a nano or micro-sized magnetic or electromagnetic field responsive material as particulates or microcapsules that are intermixed with polytetrafluoroethylene (e.g., Teflon®) nano-fibers, and using resulting fiber composites as the propellant material. Embodiments can include improved plasma system, e.g., pulsed plasma thrusters, plasma torches, plasma coating systems, etc, as well as nozzle improvements such as embodiments with magnetic structures disposed in relation to the nozzle. Alternative embodiments also include recovery and reuse systems.

24 Claims, 5 Drawing Sheets

(56) References Cited

U.S. PATENT DOCUMENTS

| | | | | |
|---|---|---|---|---|
| 2003/0217666 | A1* | 11/2003 | Herrmann | B60R 21/2644<br>102/530 |
| 2007/0075190 | A1* | 4/2007 | Kuninaka | B64G 1/405<br>244/171.1 |
| 2012/0261391 | A1* | 10/2012 | Ihde | B22F 1/02<br>219/121.52 |
| 2014/0190771 | A1* | 7/2014 | Hofer | F16N 15/00<br>184/6.22 |
| 2016/0290223 | A1* | 10/2016 | Mills | C01B 3/00 |

OTHER PUBLICATIONS

Theoretical Aspects of Nanoparticle Electric Propulsion; AIAA-2006-4335; Thomas M. Liu, Michael Keidar, Louis D. Musinski, Alec D. Gallimore, and Brian E. Gilchrist; 12 pages.

* cited by examiner

PLASMA PROPELLANT ABLATION/SUBLIMATION BASED SYSTEMS

CROSS-REFERENCE TO RELATED APPLICATIONS

The present application claims priority to U.S. Provisional Patent Application Ser. No. 62/143,319, filed Apr. 6, 2015, entitled "SYSTEMS AND METHODS FOR IMPROVING PLASMA PROPELLANT ABLATION/SUBLIMATION BASED SYSTEMS INCLUDING REDUCTION OF CARBON CHARRING DURING ABLATION OF A CARBON-BASED POLYMER AS WELL AS INCREASING THRUST, HEAT TRANSFER, AND ABLATION," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,222) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The present invention relates to systems and methods for improving plasma propellant ablation/sublimation based systems. In particular, embodiments can include improved methods and apparatuses associated with plasma pulsed thruster (PPT) including reduction of carbon charring during ablation of a carbon-fluorine polymer as well as increasing thrust, heat transfer, and ablation of the propellant.

Carbon-fluorine $(C_2F_4)_n$ based polymers can be used as a dielectric propellant material in different types of PPTs. In PPTs, an electrical potential difference can be applied between a cathode and anode separated by the dielectric propellant. Current flows across the surface of the propellant, ablating and sublimating the propellant. Heat can be generated by the potential difference causing the propellant to create plasma. The plasma is charged, and the propellant completes the circuit between the cathode and anode allowing current to flow through the plasma. The flow of electrons between the anode and cathode can generate a strong electromagnetic field, which can exert a Lorentz Force on the plasma. The plasma is accelerated away from the propellant due to the Lorentz force. Inspection of the PPT propellant surface after firing show signs of carbon charring and ablation near the electrodes, which can cause failure of the PPT due to a low energy-to-thruster radius ratio. This charring can be formed primarily from carbon, which can result in a carbon flux to be returned from the plasma rather than from the incomplete decomposition of the propellant.

According to an illustrative embodiment of the present disclosure, systems and methods for improving plasma propellant ablation/sublimation based systems are provided. One set of embodiments provides systems and methods for reducing carbon charring during plasma system (e.g., a plasma coating application system) propellant (e.g., a carbon-fluorine polymer) ablation and increasing heat transfer, ablation, and plasma thrust from plasma system. In particular, one embodiment can include using a nano or micro-sized magnetic or electromagnetic field responsive material as particulates or microcapsules that are intermixed with, e.g., polytetrafluoroethylene (e.g., Teflon®) nano-fibers, and using resulting fiber composites as the propellant material. Embodiments include improved plasma system, e.g., PPTs, plasma torch, plasma coating system, etc, as well as nozzle improvements such as embodiments with magnetic structures disposed in relation to the nozzle.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
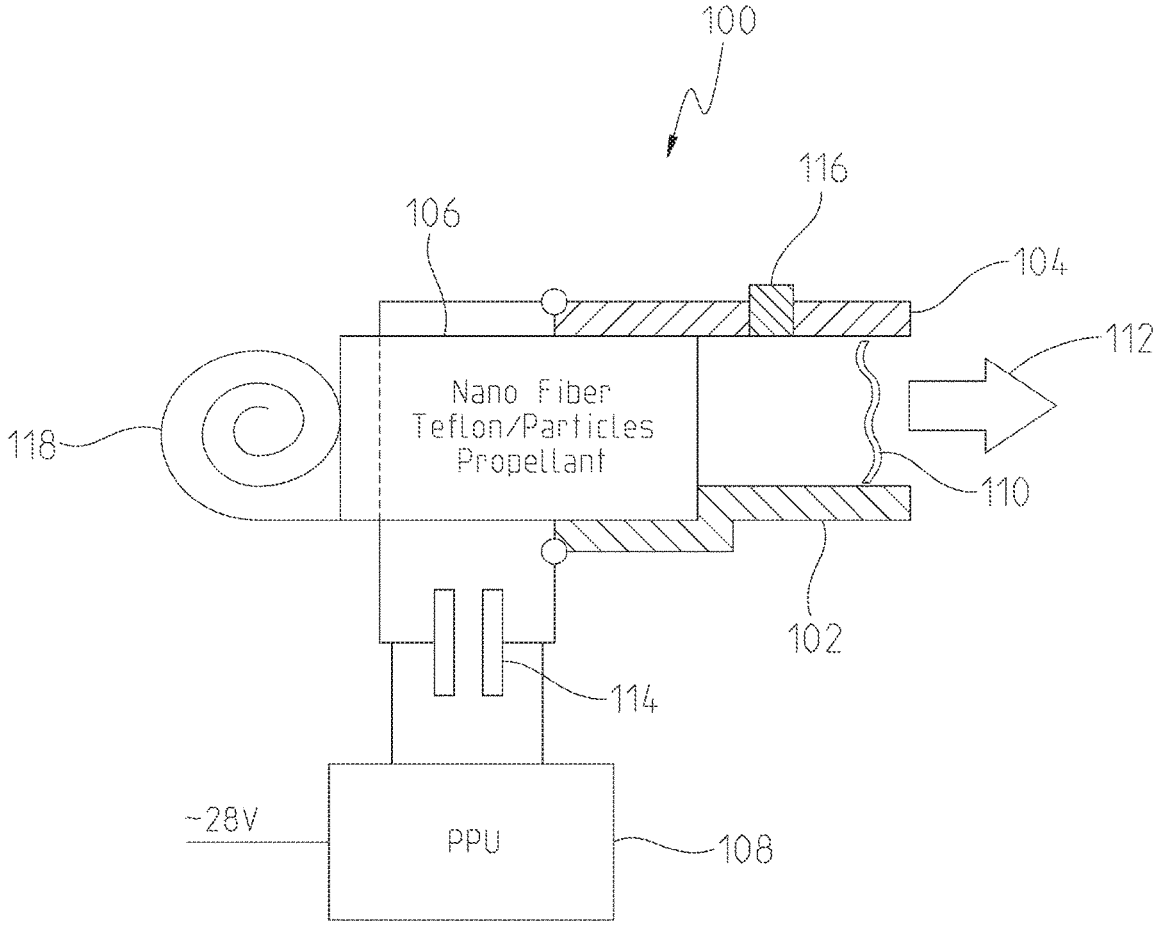
FIG. 1 shows a diagram of a PPT according to an illustrative disclosure.

Referring initially to FIG. 1, a diagram of a PPT 100 according to an illustrative embodiment of the invention is shown. The PPT 100 includes a pair of electrodes an anode 102, and a cathode 104; a propellant 106; a power supply 108; a capacitor 114; an igniter device 116; a spring 118, and nozzle exit (not shown). In embodiments an anode 102 can be an electrode through which electric current can flow into a device. A cathode 104 can be an electrode from which a current can leave a device. In an exemplary embodiment a spring can be a negator spring, which can put a constant force on a structure.

In one exemplary operation, an anode 102 is spaced apart from a cathode 104. A propellant 106 is located between the anode 102 and the cathode 104. The anode 102 can include a protruding edge to hold the propellant 106 in place. The spring 118 can provide a constant pressure on an exemplary propellant 106 in order to keep the propellant 106 pressed against the protruding edge of the anode 102. The power supply 108 is electrically connected to the anode 102 and the cathode 104 and can be used to apply an electrical potential difference between the anode 102 and the cathode 104. The capacitor 114 is connected in parallel with the voltage source 108 and anode 102 and cathode 104. The capacitor 114 protects the voltage source from large charge dumps caused by transient arcs between the anode 102 and cathode 104. The igniter device 116 can provide a large supply of free electrons to aid in the formation of plasma between the anode 102 and cathode 104. An electric potential difference between the anode 102 and the cathode 104 can cause an electrical current to flow across the surface of the dielectric propellant 106. The electrical current can cause ablation and sublimation of the propellant. Plasma 112 can be formed between the anode 102 and cathode 104. The plasma 112 is ejected away from the propellant 106 by a Lorentz force 112.

In the present embodiment, the dielectric propellant 106 is Teflon® that can include a plurality of magnetic nanoparticles dispersed throughout the dielectric propellant 106. In an alternative embodiment, the dielectric propellant 106 can be any carbon-fluorine based polymer $(C_2F_4)_n$ which can include for example, a plurality of magnetic nanoparticles dispersed throughout the dielectric propellant 106. In an alternative embodiment, the dielectric propellant 106 can include a plurality of magnetic microparticles. In an alternative embodiment, the dielectric propellant 106 can include a plurality of particles that are responsive to magnetic or electromagnetic fields, such as, for example, magnetic particles, ferromagnetic particles, diamagnetic particles, dielectric compounds of oxides or sulfides, or metal powders, such as copper, gold, or the like.

The presence of magnetic nanoparticles in the dielectric propellant 106 reduces the amount of carbon in the dielectric propellant 106, which can reduce the amount of carbon charring on the surface of the dielectric propellant 106. Additionally, the magnetic nanoparticles can have a higher thermal conductivity than the dielectric propellant 106, which can allow for better heat transfer and a higher rate of ablation. Higher ablation rates combined with the larger electrical conductivity of the magnetic nanoparticles can increase the electrical current density between the anode and cathode. Increasing the electrical current density can increase the Lorentz force and increase the thrust resulting from ejection of the plasma 112.

In certain embodiments, the Lorentz force can be further enhanced by affixing magnets to the PPT nozzle's exit to increase the magnetic field between the anode 102 and cathode 104.

Figure 2:
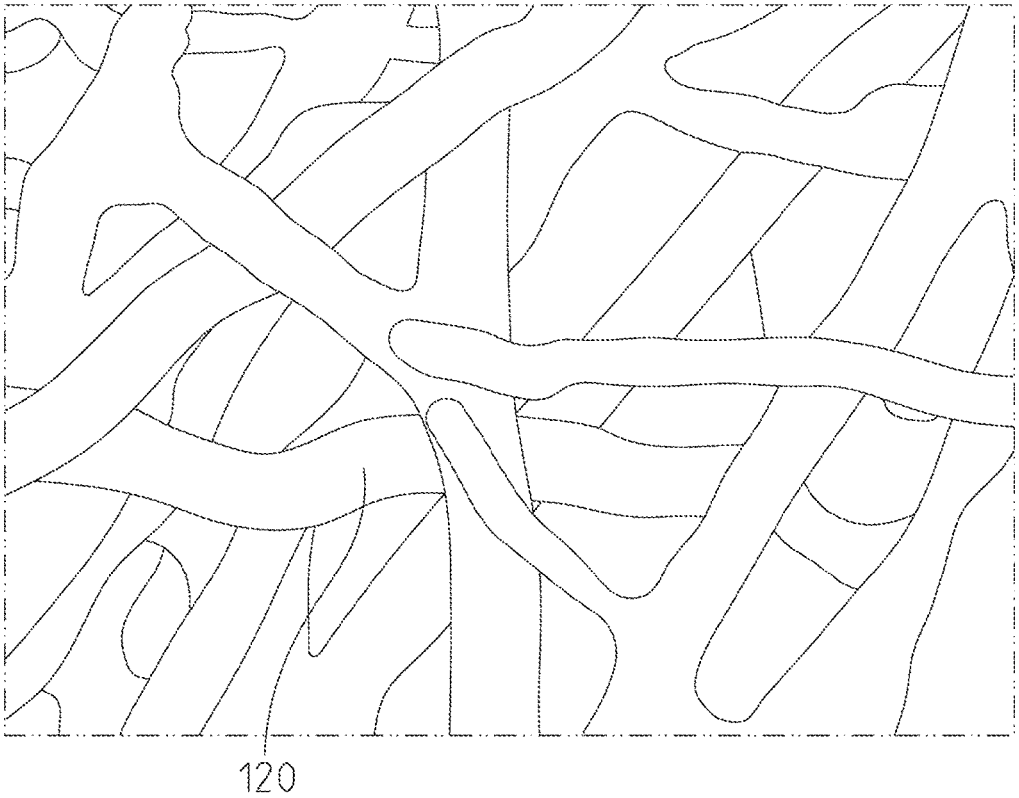
FIG. 2 shows an enlarged view of polytetrafluoroethylene including magnetic nanoparticles according to an illustrative disclosure.

Referring to FIG. 2, an enlarged view of Teflon® including magnetic nanoparticles according to an illustrative embodiment of the disclosure is shown. In an exemplary embodiment magnetic nanoparticles can be added onto Teflon® nano-fibers by using a method such as, for example, forcespinning. In an alternative embodiment, the magnetic nanoparticles may be added to any carbon-fluorine based polymer $(C_2F_4)_n$ or propellant using forcespinning, electrospinning, meltblowing, or the like. In an alternative embodiment, magnetic microparticles can be added onto the carbon-fluorine based polymer or propellant. In an alternative embodiment, a plurality of particles that are responsive to magnetic or electromagnetic fields, such as magnetic particles, ferromagnetic particles, diamagnetic particles, dielectric compounds of oxides or sulfides, or metal powders, such as copper, gold, or the like can be incorporated into the carbon-fluorine based polymer or propellant.

In the present embodiment, Teflon® with magnetic nanoparticles is used as a dielectric propellant in a pulsed plasma thruster. However, in alternative embodiments, carbon-fluorine based polymer with magnetic nanoparticles may be used in any system that ablates a dielectric material, such as a plasma torch, a weapon to release chemically active or toxic gases, substrate coating systems, heat treatment systems, etc.

Figure 3A:
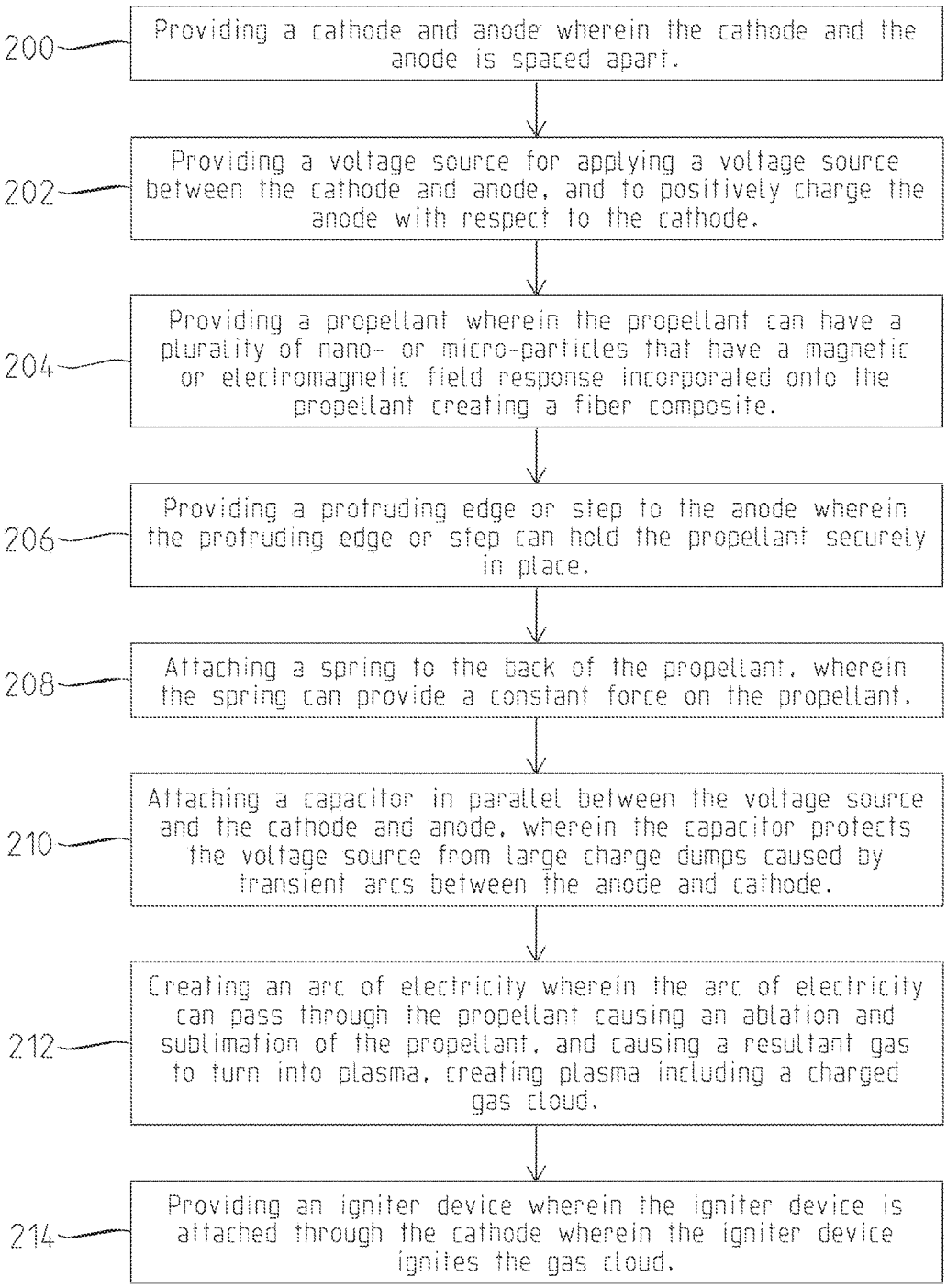
FIG. 3 shows a block diagram illustrating one method of manufacturing and use in accordance with an exemplary embodiment of this disclosure.
Figure 3B:
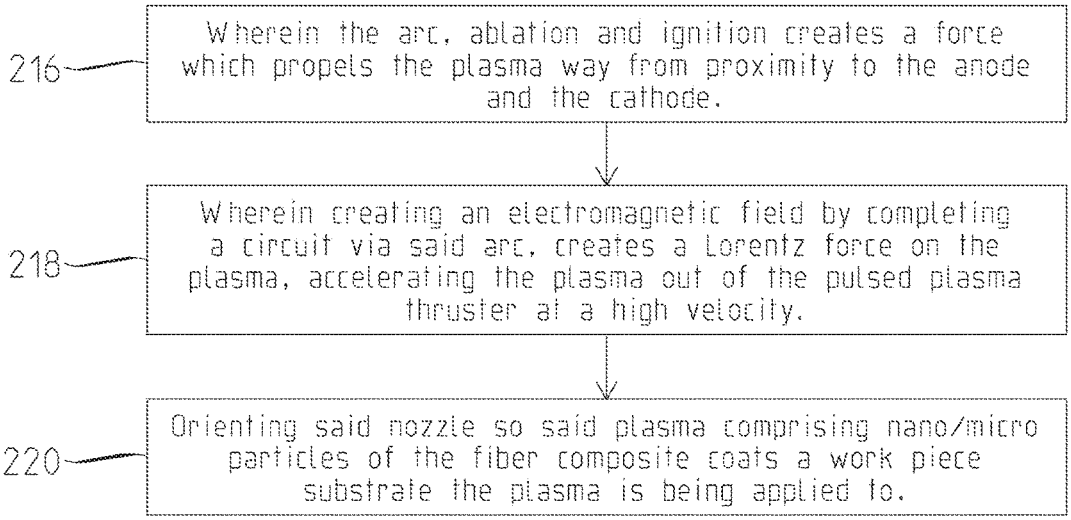

Referring to FIGS. 3*a* and 3*b*, a block diagram illustrating an exemplary method associated with manufacturing an exemplary pulsed plasma thruster. As a preliminary step, an exemplary process can include providing PPT components such as described herein. At step 200, providing a cathode and anode wherein the cathode and the anode can be spaced apart. At step 202, providing a voltage source for applying a voltage source between the cathode and anode, and to positively charge the anode with respect to the cathode. At step 204, providing a propellant wherein the propellant can have a plurality of nano- or micro-particles that have a magnetic or electromagnetic field response incorporated onto the propellant creating a fiber composite. At step 206, providing a protruding edge or step to the anode wherein the protruding edge or step can hold the propellant securely in place. At step 208, attaching a spring to the back of, wherein the spring can provide a constant force on the propellant. At step 210, attaching a capacitor in parallel between the voltage source and the cathode and anode, wherein the capacitor protects the voltage source from large charge dumps caused by transient arcs between the anode and cathode. At step 212, creating an arc of electricity wherein the arc of electricity is passed through a section of the propellant causing an ablation and sublimation of the propellant to create plasma that includes a charged gas cloud. At step 214, providing an igniter device wherein, for example, the igniter device is attached through the cathode wherein the igniter device ignites the plasma and its charged gas cloud. At step 216, wherein the arc, ablation and ignition creates a force which propels the plasma way from proximity to the anode and the cathode. For example, at step 216, creating a force from the ablation and ignition, which propels the plasma in between the anode and the cathode creating a charge, and allowing the propellant to complete a circuit between the cathode and the anode, and allowing the current to flow through the plasma. At step 218, wherein creating an electromagnetic field by completing a circuit via said arc, creates a Lorentz force on the plasma, accelerating the plasma out of the pulsed plasma thruster at a high velocity. For example, creating an electromagnetic field by completing the circuit, which creates a Lorentz force on the plasma, accelerating the plasma out of the PPT at a high velocity. At step 220, an embodiment can include orienting said nozzle so said plasma comprising nano/micro particles of the fiber composite coats a work piece substrate the plasma is being applied to.

Note that an exemplary method embodiment can add a step of providing magnets along a pulse plasma thruster nozzle exit, creating additionally thrust from the pulsed plasma thruster. An exemplary pulsed plasma thruster comprises a plurality of magnets that can be formed around the inner diameter of the pulsed plasma thruster's exit nozzle. The magnets can be used to direct or accelerate plasma. The magnets can be electromagnets to selectively adjust magnetic fields in order to alter a shape of the plasma output exiting from the nozzle. This can be used to alter, for example, diameter of plasma or to engage in adjustments to the plasma such as used with additive manufacturing (e.g. sputtering).

Plasma generation control systems can also adjust operation of a plasma generator, e.g. PPT, so that it operates or ablates on an intermittent basis which can be used to adjust output applied to a work piece in a manner that permits skipping or selective application of plasma output. Another alternative embodiment can include providing a nano or micro particle injector which also can vary content of the plasma as it is ablated which adjusts particle application to a workpiece. Embodiments can include providing and operating the nano or micro particle injector so as to be configured to inject one or more additional or different said particles into said plasma so as to vary particle content of the plasma during and after ablation which adjusts said particle type and concentration. Additional particles can be inserted into the plasma which can be used as a variable additive manufacturing system for a work piece e.g. a coating system or a system which produces additional interactions with the workpiece where the particles cause a chemical reaction with the workpiece, coat the work piece, etc.

An alternative embodiment can include providing one or more electromagnetic field generating sections along the plasma's path from ablation to the nozzle's exit that which is configured for generating an applied electric field that applies a propulsive force to the plasma and its electromagnetic sensitive particles to increase or adjust speed of the plasma towards the nozzle's exit path and push them away from the anode/cathodes. This field application provides a dual benefit of increasing plasma speed and also preventing or hindering the plasma from coating the anode or cathode and thereby damaging or clogging the plasma generator.

An alternative embodiment can be as a part of a material recovery and reuse system used in various application including environmentally sensitive applications as well as space applications. One embodiment can use a scoop system which pulls or manipulates the electromagnetic field sensitive particles out of the plasma's thrust path and then recycles them back to the plasma thrust chamber which then permits reuse of the particles. A system for transferring the particles back to a storage/reuse chamber can include additional electromagnetic field drift tubes. Fan systems can also be used to move recovered material within the material recovery and reuse system. Recovery and reuse systems can include tubing and other structures which route the particles, store them for reuse, and then re-inject them back into, e.g., the PPT. The particles in some embodiments would include coatings of the carbon polymer material that is resistant to ablation and material destruction. Another embodiment can include, for example, a system can include a portion that travels down a desired route of travel between two points laying out or spraying material that is used in as the propellant for the plasma system that includes the magnetic or electromagnetic sensitive particles. A second section can be a spacecraft that has an electromagnetic field generator on a front end ram scoop which then channels the laid out or sprayed material which the ram scoop collects and then utilizes in the PPT system. A combination of these two embodiments can also be used. A laying or spray vehicle path can be determined based on factors such as expected orbital path, impact of solar wind, volume needed for PPT operation and speed of spacecraft, etc. A laying or spray vehicle could include a cryogenic system or merely freezing the polymer/particle material and permitting solar winds or even solar concentrators on the spray or laying vehicle to melt or vaporize the material in a desired density in a manner similar to a comet ejection. A spray or laying vehicle can use a solar sail to maneuver along orbital paths using solar winds from the sun as a motive force given it does not need to be as fast as a following vehicle.

Figure 4:
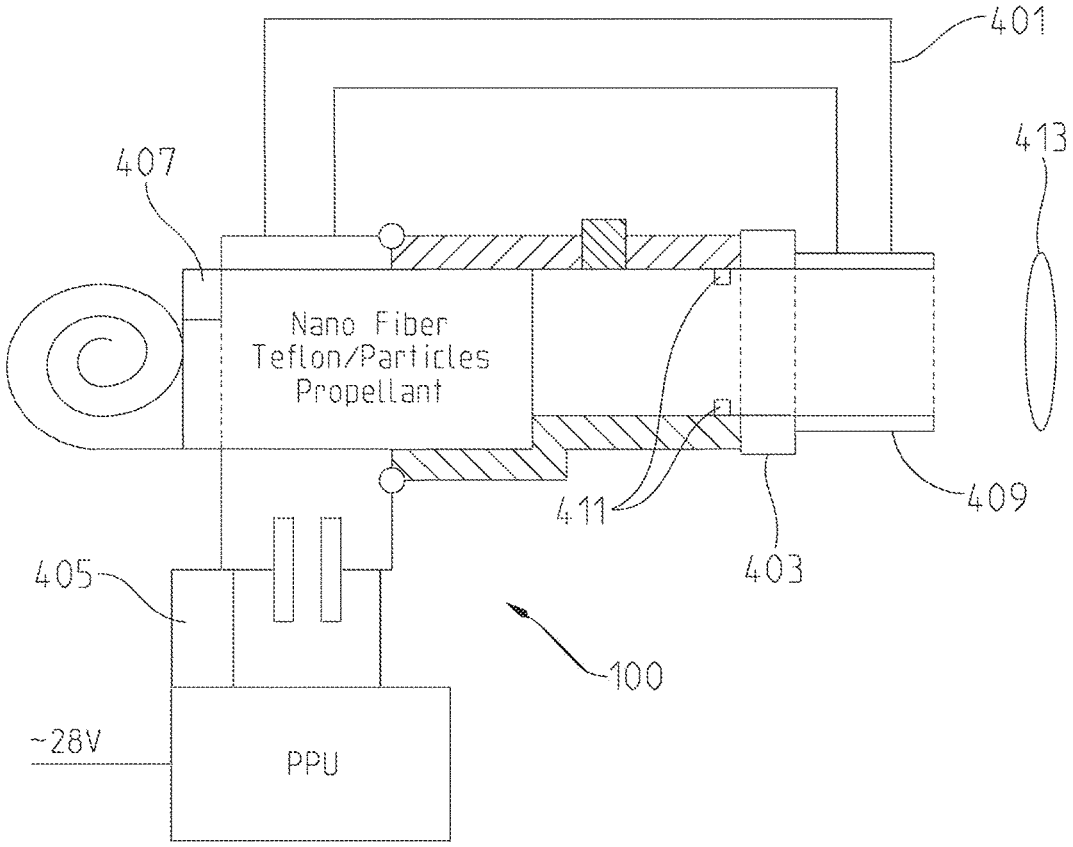
FIG. 4 shows a diagram of a PPT according to an illustrative disclosure.

FIG. 4 shows an exemplary PPT 100. A scoop system 409 pulls or manipulates the electromagnetic field sensitive particles out of the plasma's thrust path and then recycles them back to the plasma thrust chamber which then permits reuse of the particles. A system 401 for transferring the particles back to a storage/reuse chamber can include additional electromagnetic field drift tubes. One or more electromagnetic field generating sections 403 along the plasma's path from ablation to the nozzle's exit that which is configured for generating an applied electric field that applies a propulsive force to the plasma and its electromagnetic sensitive particles to increase or adjust speed of the plasma towards the nozzle's exit path and push them away from the anode/cathodes, Plasma generation control systems 405 can also adjust operation of a plasma generator, e.g. PPT 100, so that it operates or ablates on an intermittent basis which can be used to adjust output applied to a work piece 413 in a manner that permits skipping or selective application of plasma output. A nano or micro particle injector 407 can vary content of the plasma as it is ablated which adjusts particle application to a workpiece 413. Lorentz force can be further enhanced by affixing magnets 411 to the PPT 100 nozzle's exit.

Although the invention has been described in detail with reference to certain preferred embodiments, variations and modifications exist within the spirit and scope of the invention as described and defined in the following claims.

The invention claimed is:

1. A pulsed plasma thruster system, said system including: a plasma reaction chamber comprising a cathode, a nozzle formed with an exit, and an anode, wherein said pulsed plasma thruster system is configured to generate an electrical potential difference that is applied between said anode and said cathode; a propellant disposed within said plasma reaction chamber, wherein said propellant is located between said anode and said cathode between an area where the electrical potential difference is generated, wherein said propellant includes a polymer that is carbon-fluorine based, wherein said propellant further includes particles with an electrical conductivity greater than an electrical conductivity of said polymer, wherein said electrical potential difference causes an electric current to flow across a surface of said propellant, wherein said electric current ablates said propellant and creates a carbon-fluorine plasma, wherein said carbon-fluorine plasma includes said particles; and a section for transferring the particles back to a storage/reuse chamber comprising electromagnetic field drift tube sections as well as fan systems.

2. The pulsed plasma thruster system of claim 1, wherein said particles increase the current density in said carbon-fluorine plasma.

3. The pulsed plasma thruster system of claim 1, wherein said polymer includes polytetrafluoroethylene.

4. The pulsed plasma thruster system of claim 1, wherein said particles include magnetic compounds.

5. The pulsed plasma thruster system of claim 1, wherein said particles include metal powder.

6. The pulsed plasma thruster system of claim 1, further comprising a plurality of magnets attached around an inner diameter of said nozzle.

7. The pulsed plasma thruster system of claim 1, further comprising one or more electromagnetic field generating sections along a thrust path of the carbon-fluorine plasma from ablation to the exit that which is configured for selectively generating an applied electric field that applies a propulsive force to the carbon-fluorine plasma and the particles to increase or adjust speed of the carbon-fluorine plasma towards the exit and push carbon-fluorine plasma and the particles away from the anode/cathodes.

8. The pulsed plasma thruster system of claim 1, further comprising a pulsed plasma thruster system control system section configured for adjusting operation of the pulsed plasma thruster system so that the pulsed plasma thruster system operates or ablates the propellant on an intermittent basis operable for adjusting plasma output applied to a work piece in a manner that configured for intermittent or selective application of the plasma output.

9. The pulsed plasma thruster system of claim 1, further comprising a nano or micro particle injector configured to inject one or more additional or different said particles into said carbon-fluorine plasma so as to vary particle content of the carbon-fluorine plasma during and after ablation which adjusts particle type and concentration.

10. The pulsed plasma thruster system of claim 1, further comprising a scoop and recovery system section which pulls or manipulates the particles out of the thrust path and then recycles the particles by routing the particles back to the plasma thrust chamber which then permits reuse of the particles.

11. A method of a providing and operating a pulsed plasma thruster system comprising: providing a plasma generation system comprising an anode, cathode, voltage source, nozzle, and plasma reaction chamber that said anode, cathode, voltage source, and said nozzle are coupled with and connected with or disposed at least partially within, wherein said nozzle is formed to provide an exit for plasma generated by said system, wherein said voltage source is configured for applying a current between said cathode and said anode, wherein said anode is positively charge with respect to said cathode, wherein a propellant is located between said anode and said cathode between an area where an electrical potential difference is generated by said cathode and anode, wherein said propellant comprises a carbon based propellant and a plurality of nano- or micro-particles that have a magnetic or electromagnetic field response incorporated onto said propellant creating a fiber composite; creating an arc of electricity in said area of electrical potential difference wherein said arc of electricity passes through said propellant causing an ablation and sublimation of said propellant to create a charged gas cloud; providing and operating an igniter device wherein said igniter device is attached through said cathode, wherein said igniter device ignites said charged gas cloud and generates said plasma that is generated within said plasma reaction chamber and expelled through said nozzle;

wherein said arc creates an electromagnetic field that creates a Lorentz force on said nano- or micro-particles in said plasma, accelerating said plasma out of said nozzle at a higher velocity than said carbon based propellant without said nano- or micro-particles;

and providing and operating a section for transferring the particles back to a storage/reuse chamber comprising electromagnetic field drift tube sections as well as fan systems.

12. method of claim 11, wherein said nozzle exit further comprises a plurality of magnets around an inner diameter of said nozzle.

13. A method of claim 11, further comprising orienting said nozzle towards a work piece so as to apply said plasma on said work piece.

14. A method of claim 13, wherein said plasma and system are configured and operated to coat said workpiece with said nano- or micro-particles.

15. A method of claim 13, wherein said plasma and pulsed plasma thruster system are configured and operated to cut said workpiece.

16. A method of claim 11, further comprising providing and operating one or more electromagnetic field generating sections along a path of the plasma from ablation to the exit which is configured for selectively generating an applied electric field that applies a propulsive force to the plasma and the nano- or micro-particles to increase or adjust speed of the plasma towards the exit and push the plasma and the nano- or micro-particles away from the anode/cathodes.

17. A method of claim 11, further comprising providing and operating a pulsed plasma thruster system control system section configured for adjusting operation of the pulsed plasma thruster system so that pulsed plasma thruster system operates or ablates the propellant on an intermittent basis operable for adjusting plasma output applied to a work piece in a manner that configured for intermittent or selective application of the plasma output.

18. A method of claim 11, further comprising providing and operating a nano or micro particle injector configured to inject one or more additional or different said particles into said plasma so as to vary particle content of the plasma during and after ablation which adjusts particle type and concentration.

19. The method of claim 11, further comprising a scoop and recovery system section which pulls or manipulates the particles out of the a thrust path of the plasma and then recycles them by routing them back to the plasma thrust chamber which then permits reuse of the particles.

20. A pulsed plasma thruster system, said system including: a plasma reaction chamber comprising a cathode, a nozzle formed with an exit, and an anode, wherein said system is configured to generate an electrical potential difference that is applied between said anode and said cathode; and a propellant disposed within said reaction chamber, wherein said propellant is located between said anode and said cathode between an area where the electrical potential difference is generated, wherein said propellant includes a carbon-fluorine based polymer, wherein said propellant further includes particles with an electrical conductivity greater than the electrical conductivity of said polymer, wherein said electrical potential difference causes an electric current to flow across the surface of said propellant, wherein said electric current ablates said propellant and creates a carbon-fluorine plasma, wherein said carbon-fluorine plasma includes said particles, wherein said particles increase the current density in said carbon-fluorine plasma, wherein said particles include magnetic compounds, wherein said particles include metal powder; a plurality of magnets attached around an inner diameter of said exit; one or more electromagnetic field generating sections along a thrust path of the carbon-fluorine plasma from ablation to the exit that which is configured for selectively generating an applied electric field that applies a propulsive force to the plasma and the particles to increase or adjust speed of the carbon-fluorine plasma towards the exit and push carbon-fluorine plasma and the particles away from the anode/cathodes; a pulsed plasma thruster system control system section configured for adjusting operation of the pulsed plasma thruster system so that it operates or ablates the propellant on an intermittent basis operable for adjusting plasma output applied to a work piece in a manner that configured for intermittent or selective application of the plasma output; a nano or micro particle injector configured to inject one or more additional or different said particles into said plasma so as to vary particle content of the plasma during and after ablation which adjusts particle type and concentration; a scoop and recovery system section which pulls or manipulates the particles out of the plasma's thrust path and then recycles them by routing them back to the plasma thrust chamber which then permits reuse of the particles; and a section for transferring the particles back to a storage/reuse chamber comprising electromagnetic field drift tube sections as well as fan systems.

21. A system as in claim 20, wherein said carbon-fluorine based polymer includes polytetrafluoroethylene.

22. A method of a providing and operating a pulsed plasma thruster system comprising: providing a plasma generation system comprising an anode, cathode, voltage source, nozzle, and plasma reaction chamber that said anode, cathode, voltage source, and said nozzle are coupled with and connected with or disposed at least partially within, wherein said nozzle is formed to provide an exit for plasma generated by said system, wherein said voltage source is configured for applying a current between said cathode and said anode, wherein said anode is positively charge with respect to said cathode, wherein a propellant is located between said anode and said cathode between an area where an electrical potential difference is generated by said cathode and anode, wherein said propellant comprises a carbon based propellant and a plurality of nano- or micro-particles that have a magnetic or electromagnetic field response incorporated onto said propellant creating a fiber composite; creating an arc of electricity in said area of electrical potential difference wherein said arc of electricity passes through said propellant causing an ablation and sublimation of said propellant to create a charged gas cloud; providing and operating an igniter device wherein said igniter device is attached through said cathode, wherein said igniter device ignites said charged gas cloud and generates said plasma that is generated within said plasma reaction chamber and expelled through said nozzle; wherein said arc creates an electromagnetic field that creates a Lorentz force on said nano- or micro-particles in said plasma, accelerating said plasma out of said nozzle at a higher velocity than said carbon based propellant without said particles, wherein said nozzle exit further comprises a plurality of magnets around an inner diameter of said exit; orienting said nozzle towards a work piece so as to apply said plasma on said work piece; providing and operating one or more electromagnetic field generating sections along a path of the plasma from ablation to the exit that which is configured for selectively generating an applied electric field that applies a propulsive force to the plasma and particles to increase or adjust speed of the plasma towards the exit and push them away from the anode/cathodes; providing and operating a pulsed plasma thruster system control system section configured for adjusting operation of the pulsed plasma thruster system so that the pulsed plasma thruster system operates or ablates the propellant on an intermittent basis operable for adjusting plasma output applied to a work piece in a manner that configured for intermittent or selective application of the plasma output; providing and operating a section for transferring the particles back to a storage/reuse chamber comprising electromagnetic field drift tube sections as well as fan systems; providing and operating a nano or micro particle injector configured to inject one or more additional or different said particles into said plasma so as to vary particle content of the plasma during and after ablation which adjusts particle type and concentration; and providing and operating a scoop and recovery system section which pulls or manipulates ablated particles out of a thrust path of the plasma and then recycles them by routing them back to the plasma thrust chamber which then permits reuse of the particles.

23. A method as in claim 22, wherein said pulsed plasma thruster system is configured and operated to coat said work piece with said particles.

24. A method of claim 22, wherein said pulsed plasma thruster system is configured and operated to cut said work piece.

* * * * *